United States Patent [19]

Barnes et al.

[11] 3,935,422

[45] Jan. 27, 1976

[54] ELECTRICALLY HEATED LAMINATE WITH A GLASS HEATING FABRIC

[75] Inventors: Richard D. Barnes, Stokesdale; William E. Sharpe, Jr., Greensboro, both of N.C.

[73] Assignee: Burlington Industries, Inc., Greensboro, N.C.

[22] Filed: Dec. 16, 1974

[21] Appl. No.: 533,176

Related U.S. Application Data

[62] Division of Ser. No. 441,817, Feb. 12, 1974, Pat. No. 3,876,968.

[52] U.S. Cl. ..... 219/213; 219/345; 219/543; 252/511; 338/212

[51] Int. Cl.[2] ..... H05B 3/34

[58] Field of Search ..... 219/213, 345, 528, 529, 219/543, 548, 549; 252/506, 511; 338/210, 211, 212; 52/273

[56] References Cited

UNITED STATES PATENTS

| | | | |
|---|---|---|---|
| 2,314,766 | 3/1943 | Bull et al. | 219/213 |
| 2,991,257 | 7/1961 | Smith-Johannsen | 252/506 |
| 3,056,750 | 10/1962 | Pass | 252/511 |
| 3,287,684 | 11/1966 | Armbruster, Jr. | 338/211 |
| 3,385,959 | 5/1968 | Ames et al. | 219/549 |
| 3,387,248 | 6/1968 | Rees | 338/211 |
| 3,400,254 | 9/1968 | Takimori | 219/549 |
| 3,573,427 | 4/1974 | Minsle | 219/213 |
| 3,721,800 | 3/1973 | Eisler | 219/213 |
| 3,808,403 | 4/1974 | Kamaya et al. | 219/528 |
| 3,866,016 | 2/1975 | Tombu | 219/213 |

*Primary Examiner*—Volodymyr Y. Mayewsky
*Attorney, Agent, or Firm*—Cushman, Darby & Cushman

[57] ABSTRACT

An electrically heated laminate including a flexible heater fabric, wherein the heater fabric comprises a woven glass fabric having a layer in contact with electrodes of an electrically conductive mixture comprising a vinylidene chloride polymer and carbon to provide the desired watt density and an outer coating of a vapor barrier of a vinylidene chloride polymer. A fabric softener layer may also be provided between the glass fabric and the conductive coating to impart greater flexibility to the heater fabric.

3 Claims, 8 Drawing Figures

MAXIMUM AND MINIMUM RATIO OF CARBON TO POLYVINYLIDENE CHLORIDE FOR A SPECIFIC RESISTANCE

ELECTRICALLY HEATED LAMINATE WITH A GLASS HEATING FABRIC

This is a division, of application Ser. No. 441,817 filed Feb. 12, 1974, now U.S. Pat. No. 3,876,968.

BACKGROUND OF THE INVENTION

The present invention relates to a heater fabric and method of making the same.

For many years the only satisfactory source of a semi-flexible heater material was a product known as a heater cable. By arranging these heater cables in equally spaced configurations it was possible to provide a large flat area of radiant heat source. These heater cables were all made by insulating an alloy resistance wire, such as Chromel (Trademark of Haskins Mfg. Co. for a series of Ni-Cr alloys) and then encasing the insulated heater wire in a metallic sheath.

More recently, there have been many attempts to develop other types of flexible heater products, such as woven graphite fibers, sheets of conducting material sandwiched between a film or fabric coated with conducting compounds and enclosing in insulating film. See U.S. Pat. Nos. 3,146,340 and 3,400,254.

In all cases, when these products were put in service it was necessary to encase them in protective film to protect them from moisture and from the hazardous contact with the surface of the "live" electric circuit. However, the presence of this film is a serious deterent to its use in many applications, such as molded ceiling tile, plaster board, etc.

U.S. Pat. No. 2,473,183 teaches coating a woven fabric with a vinyl resin containing conducting carbon black, plus an over coating of a non-conductive material, such as plasticized vinyl resin to protect a person from getting electrical shock when touching the surface.

The insulating coating of this patent being a plasticized vinyl resin will not sufficiently protect the conducting coating since a 3 mil vinyl coating would have a moisture vapor transmission of from 0.5 to 1.0 perms.

U.S. Pat. No. 3,112,985 teaches the bonding of a film of polyvinylidene chloride to paper for the purpose of making it greaseproof and resistant to the passage therethrough of water vapor.

U.S. Pat. No. 3,359,525 teaches coating glass fabric with a conductive coating of polyimide resin and conducting carbon black followed by an insulating coating of a polyimide resin. This provides an insulating coating over the conductive coating, but not a good vapor varrier. This product is designed to operate at 600°F.

None of these products has proven satisfactory, as witnessed by the fact that the Underwriters' Laboratories, Inc. do not include any such heater devices on its list of approved radiant heat sources.

The heater cable is still the only recognized and approved source of radiant heat for installation in homes, driveways, etc.

It is the object of this invention to produce a flexible heat source that will satisfactorily overcome all the previous objections and provide a reliable heat source in the range of 10 to 70 watts per square foot. Such a product would be suitable for a large variety of end uses, such as home heating in the form of a ceiling tile or ceiling board, preventing ice on bridges, roadways, and airport runways, heated plant beds, matress pads, heated storage tanks, etc.

SUMMARY OF THE INVENTION

A heater fabric, and a method of fabrication are provided wherein the heater fabric comprises a woven glass fabric coated with a layer of a conductive mixture comprising a vinylidene chloride polymer and carbon to provide the desired watt density and an over coating of vapor barrier of a vinylidene chloride polymer. A fabric softener layer may be provided between the glass fabric and the conductive coating to impart greater flexibility to the heater fabric.

The vapor barrier of the vinylidene chloride polymer protects the conducting layer from moisture and accidental contact with the live circuit.

Unexpectedly it has been found that the vapor barrier coating serves further to bond the conducting particles in the base coat more compactly together giving the product a more uniform resistance. The vapor barrier coating also improves the flex properties of the heater fabric.

Another unexpected feature of the glass heater fabric of the present invention is that cutouts, such as needed for a lamp fixture, can be made without affecting its ability to continue to operate as a heat source.

An advantage of the present invention is the ease with which the heater fabric can be incorporated in an article of manufacture, as for example, a plaster board.

Plaster boards with a heater cable as an integral part of the board for radiant ceiling heating are known. This product is made for example by routing out a trench in the plaster board, inserting an insulated heater cable, filling the trench with plaster, and facing the board with paper.

The glass heater fabric which will be used according to the present invention for incorporation into such articles as plaster board, ceiling tile, etc. is an open weave construction having openings approximately 1/16 inch square. Because each individual yarn in the fabric is surrounded by the vapor barrier coating and insulated and protected from moisture, the glass heater fabric can be molded in the wet plaster slurry in a simple operation. The wet plaster slurry will key through the openings in the heater fabric and the heater fabric will become an integral part of the structure. Not only will the glass heater fabric serve as a heat source, but it will also reinforce the plaster board. In contrast, with a conventional heater fabric enclosed in a plastic film, the plaster will not stick to the film, and subsequent delamination will occur.

DESCRIPTION OF THE INVENTION

The heater fabric of the present invention comprises a woven glass fabric treated with a conductive mixture of carbon and a vinylidene chloride polymer to provide the desired watt density and then coated with a vinylidene chloride polymer vapor barrier having a moisture vapor transmission of 0.02 perms or less. The vapor barrier serves to protect the conducting mixtures from attack by moisture and at the same time eliminates the hazard of contact with the "live" electric circuit.

Figure 2:
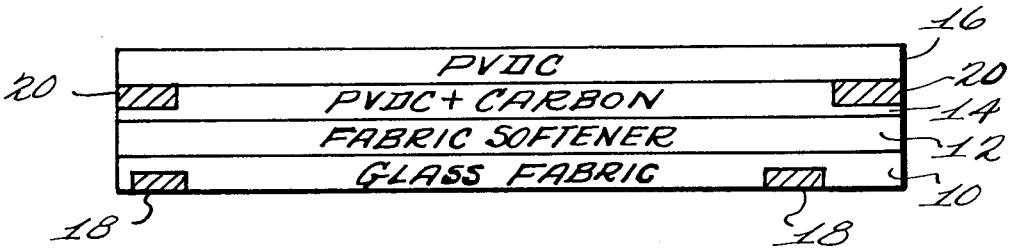
FIG. 2 is a schematic cross section of a heater fabric according to the present invention.

One type of heater fabric according to the present invention is shown in FIG. 2 where the various layers are shown schematically rather than in their relative proportions. The glass fabric 10 is coated in sequence with a conductive layer 14 of carbon and a polymer of vinylidene chloride, such as polyvinylidene chloride (PVDC) and then an outer vapor barrier layer 16 of PVDC. Copper or other suitable metal electrodes are provided to dissipate the heat to the conductive layer 14 by weaving the glass fabric with the electrodes as shown by 18 or by attaching the electrodes 20 to the coated fabric before the vapor barrier 16 is added.

A fabric softener 12 may be app.ied to the glass fabric 10 to impart more flexibility to the heater fabric.

The form of the carbon suitable for the conductive layer is not important for the heater fabric operation so long as the carbon particles are of a sufficient size to be embedded in a continuous coating when mixed with the vinylidene chloride polymer. Carbon black is one preferred from. Another is Vulcan XC-72 which is specifically made for use as a conducting medium and has excellent conductivity characteristics. Vulcan XC-72 has an ASTM D2516 classification of N472, an average particle size of 35 millimicrons, $N_2$ surface areas of 254 square meters per gram and its DBP absorption is 200 cc/100g. The amount of carbon in the conductive coating varies over a wide range of concentrations depending on the desired watt density of the heater fabric and coating thickness. For most practical applications, the weight ratio of carbon to vinylidene chloride polymer is in the range of 20:80 to 80:20. Carbon is calculated as 100 percent solids and vinylidene chloride polymer is calculated as 62 percent solids present in the emulsion.

The vapor barrier has a moisture vapor transmission of 0.02 perms or less and is formed from polymers of vinylidene chloride. By the terms "polymers of vinylidene chloride" or "vinylidene chloride polymers" it is meant to include not only the homopolymer but also various high vinylidene chloride content copolymers, terpolymers, etc.

Two of the important characteristics of polymers of vinylidene chloride ($CH_2 = CCl_2$) are thermal stability and impermeability to gases and vapors. Various polymers of vinylidene chloride which may be employed in the present invention are known and subsequently described in Volume 14, pages 540–579 of *Encyclopedia of Polymer Science and Technology*, 1971, John Wiley and Sons, Inc., which is hereby incorporated by reference.

The usefulness of polymers of vinylidene chloride depends on the permeability of the polymer which in turn depends on the density and crystallinity of the polymer. The homopolymer of vinylidene chloride has a lower impermeability than most other copolymers of vinylidene chloride and is therefore best suited for the vapor barrier. However, availability and fabrication problems arise in the use of PVDC and therefore various copolymers of vinylidene chloride may also be employed. Polar comonomers and plasticizers increase the permeability of the polymer film as compared to PVDC and therefore use of such films depends on the requirements of the vapor barrier.

The preferred copolymers are those which comprise at least 50 molar percent of vinylidene chloride with the balance comprising another vinyl monomer such as styrene, vinyl chloride, acrylonitrile, methyl acrylate, methyl methacrylate, ethyl acrylate and vinyl acetate. Terpolymers or polymers comprising four or more comonomers may also be employed so long as sufficient vinylidene chloride is present to impart the necessary impermeability to the polymer film. Various graft copolymers of vinylidene chloride are also suitable for the present invention.

Commercially available vinylidene chloride polymers are Saran A (homopolymer), Saran B (vinylidene chloride-vinyl chloride copolymer), Saran C (vinylidene chloride-acrylonitrile copolymer) and Saran F (vinylidene chloride-acrylonitrile copolymer), all available from Dow Chemical.

The polymer type in the conductive coating is not as important as the vapor barrier polymer since only the high thermal stability of vinylidene chloride polymers is involved whereas the vapor barrier requires a coating of low permeability. Generally, however, the same type of polymers suitable for the vapor barrier are also suitable for the conductive coating with the homopolymer of vinylidene chloride being preferred for both the conductive coating and the vapor barrier.

The conductive coating thickness varies over a wide range depending on the desired use of the heater fabric and the required watt density. Generally, because of the increasing resistance of a lower limit of 0.01 oz/sq. yd. is maintained with an upper limit being determined by economics, overall thickness requirements and required watt densities. Therefore, a preferred range is 0.01 to 3 oz/sq. yd. and a more preferred range is 0.20 to 0.60 oz/sq. yd. It is obvious that various coating weights can be varied depending on the carbon/PVDC ratio for a given resistance. Thus, by varying the ratio of conducting carbon to polyvinylidene chloride and the coating weight, the electrical resistance can be varied over a wide range; i.e., from 5 ohms per square foot to 5000 ohms per square foot.

The manufacture of the heater fabric of the present invention is a multi-step process which may be carried out as follows:

1. Weave glass fabric with copper wires (electrodes) spaced at selected distances across the width of the fabric.

2. Gently heat clean the woven fabric, as for example according to the process outlined in U.S. Pat. No. 2,970,934, which is hereby incorporated by reference, to remove the residual or original starch and oil binder applied during the manufacture of the glass yarns without adversely affecting any of the copper electrodes so that a clean glass surface is available on which to bond a conductive coating.

3. Coat the fabric with a formula consisting of a polymer of vinylidene chloride mixed in different ratios of carbon to give the desired electrical resistance, dry and cure this coating at temperatures of 250° to 450°F for a period of ½ to 2 minutes. Drying temperatures between 250°F and 450°F show no effect on the electrical resistance of the glass heater fabric.

4. Apply 1,2, or 3 coats of a vinylidene chloride polymer vapor barrier coating to obtain a moisture vapor transmission rating of 0.02 perms or less, and at the same time insulate the conducting surface against accidental contact with the electrical circuit.

As an alternate to steps 1, 2, and 3, the glass fabric could be woven in the conventional manner without the copper electrodes, heat cleaned as in step 2, and coated with the conducting coating, as in step 3. The copper electrodes would then be placed on the fabric by sewing or with a pressure sensitive adhesive. Following the attachment of the copper electrodes, the vapor barrier coatings would be applied to the fabric as outlined in step 4 above.

The following table is a list of the materials used in the examples with their corresponding composition.

TABLE 1

| Material | Composition |
|---|---|
| Vulcan XC-72 (G. L. Cabot Inc.) | highly reinforcing furnace carbon black |
| Tamol SN (Rohm & Haas Co.) | anionic, polymeric tanning and dispersing agents |
| TSPP | anhydrous tetrasodium pyrophosphate |
| Polidene M3-120 | polyvinylidene chloride copolymer emulsions |
| Polycryl 7-F-1 | acrylic polymers and copolymers polymerized in a solvent medium and supplied in 40–50% solutions in toluene, MEK and other solvents |
| Glass fabric style 7628 | woven glass fabric |
| Glass fabric style 1562/38 | open weave leno style glass fabric |

The following examples will serve to further illustrate the present invention:

EXAMPLE 1

Glass fabric style 7628 was heat cleaned to remove the oil and starch binder and then treated as follows:

| Solution A | | | Solution B | | |
|---|---|---|---|---|---|
| Water | — | 500 grams | Solution A | — | 100 grams |
| Tamol SN | — | 15 grams | Polidene M3-120 | — | 31.4 grams |
| TSPP | — | 5 grams | | | |
| Vulcan XC-72 | — | 60 grams | | | |

The fabric was given 1, 2 and 3 applications of Solution B and dried at 350°F for 1 minute between each application of Solution B. The following electrical resistance was obtained:

Single Treatment — 4000 ohms resistance — weight 0.22 oz. sq./yd.

Double Treatment — 833 ohms resistance — weight 0.44 oz. sq./yd.

Third Treatment — 441 ohms resistance — weight 0.55 oz. sq./yd.

As shown by this example, the resistance can be controlled by the coating weight when the ratio of carbon and polyvinylidene chloride is constant.

When the above samples were treated with a polyvinylidene chloride vapor barrier coating, the resistance did not change appreciably.

EXAMPLE 2

Glass fabric style 7628 was heat cleaned to remove the starch and oil binder and treated as follows:

| Solution A | | | Solution B | | |
|---|---|---|---|---|---|
| Water | — | 900 grams | Solution A | — | 100 grams |
| Tamol SN | — | 45 grams | Polidene M3-120 | — | 24.0 grams |
| TSPP | — | 15 grams | | | |
| Vulcan XC-72 | — | 180 grams | | | |

The glass fabric was given three applications of Solution B and dried at 350°F for 1 minute between each application.

The fabric had an electrical resistance of 316 ohms per square foot.

One-half inch wide copper electrodes were sewn on opposite sides of a 10 × 10 inch fabric sample and the fabric sample was given two coats of the polyvinylidene chloride vapor barrier. This sample was connected to 110 volts A.C. A beaker containing 100 grams of water was placed on top of the heater fabric and the temperature of the water rose from 65°F to 130°F.

EXAMPLE 3

Glass fabric style 7628 was heat cleaned to remove the starch and oil binder and treated as follows:

| Solution A | | | | | |
|---|---|---|---|---|---|
| Water | — | 500 grams | Solution A | — | 100 grams |
| Tamol SN | — | 15 grams | Polidene M3-120 | — | 23.6 grams |
| TSPP | — | 5 grams | | | |
| Vuncan XC-72 | — | 60 grams | | | |

The fabric was treated three and four times with solution B and dried at 350°F for 1 minute between each treatment. Following this the polyvinylidene chloride vapor barrier treatment was applied.

The following electrical resistance was obtained:

3 treatments — 425 ohms per sq. ft.
4 treatments — 316 ohms per sq. ft.

By comparing examples 1, 2 and 3 at the third treatment level, the following summary can be made:

| | Formula | Resistance |
|---|---|---|
| Example 1 | 60 parts Vulcan XC-72<br>102 parts Polidene M3-120( | 441 ohms/sq. ft. |
| Example 2 | 120 parts Vulcan XC-72<br>102 parts Polidene M3-120( | 316 ohms/sq. ft. |
| Example 3 | 80 parts Vulcan XC-72<br>102 parts Polidene M3-120( | 425 ohms/sq. ft. |

Figure 1:
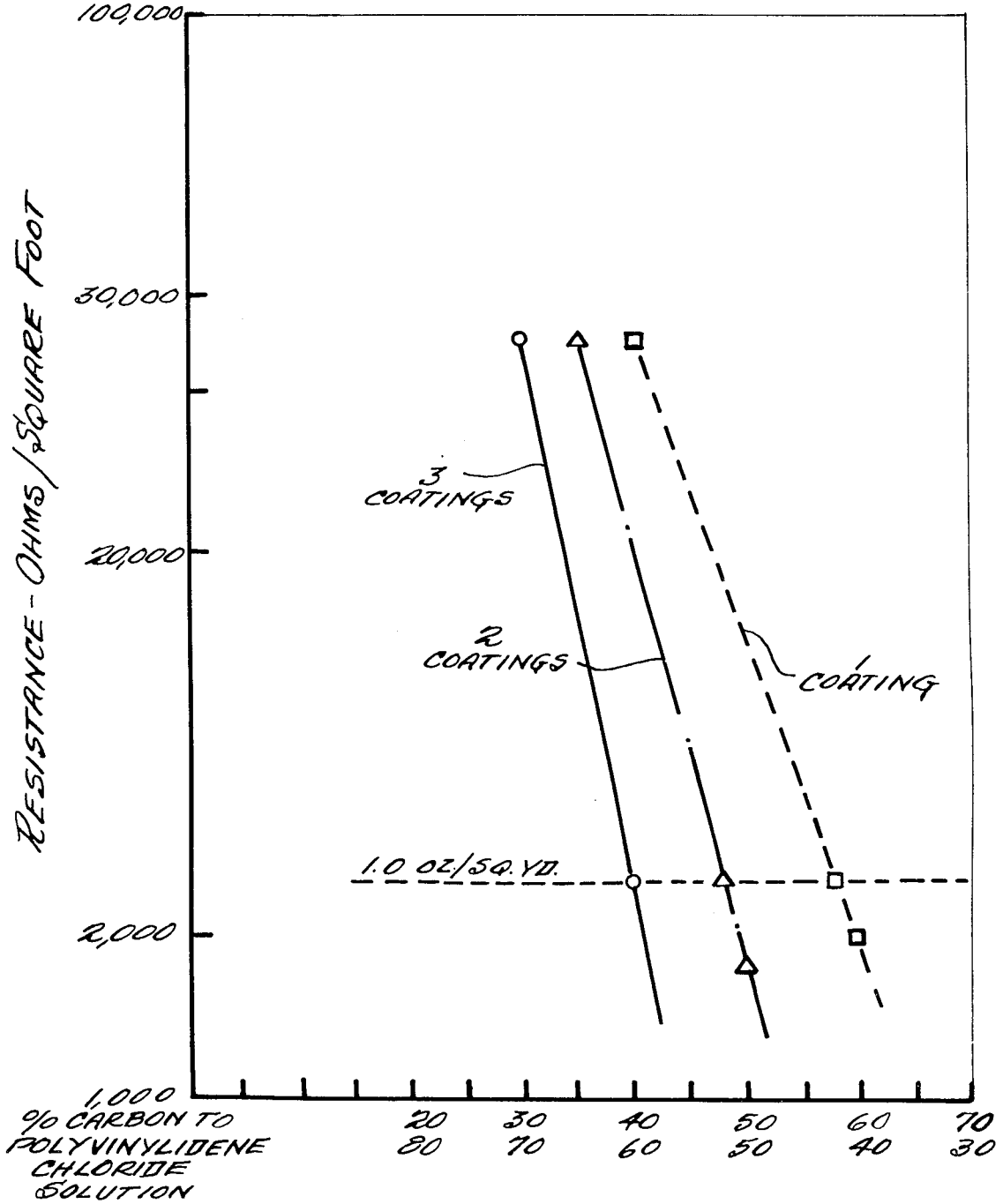
FIG. 1 is a semi-log graph of the resistance of a heater fabric versus the carbon/PVDC ratio of the conducting layer in the heater fabric.

It has been found that there is a maximum and minimum ratio of carbon to polyvinylidene solution in order to make a satisfactory heater fabric in the range of 10 to 60 watts per square foot. These ratios are shown in FIG. 1. Greater or lesser ratios may be employed to achieve different power rated fabric heaters.

From the curves shown in FIG. 1, information can be extracted concerning the minimum and maximum ratios for a given resistance. For example, for a resistance of 2500 ohms per square foot and a coating weight of 1.0 oz./sq. yd., the minimum ratio of carbon to polyvinylidene solution is 40 to 60, and the maximum ratio is 58 to 42 for a fabric heater ration of 10 to 60 watts per square foot.

EXAMPLE 4

Glass fabric style 7628 was heat cleaned to remove the starch and oil binder and knife coated on one side only with the following formula:

| | | |
|---|---|---|
| Water | — | 324.0 grams |
| Tamol SN | — | 25.2 grams |
| TSPP | — | 8.4 grams |
| Vulcan XC-72 | — | 100.8 grams |
| Polidene M3-120 | — | 344.0 grams |

The coating was dried at 300°F for 1 minute.

The electrical resistance of the one-side coated fabric was 700 ohms per square foot.

The uncoated side of the above sample was then knife coated with the same solution, dried at 300°F for 1 minute. The electrical resistance was now 360 ohms per square foot.

EXAMPLE 5

A sample of heat cleaned style 7628 glass fabric was treated with a 20% aqueous solution of Polycryl 7-F-1 and dried 1 minute at 300°F. This sample was then coated as in Example number 4 with the following results:

Polycryl with 1-side knife coated — 860 ohms per square foot

Polycryl with 2-side knife coated — 315 ohms per square foot

The polycryl made the finished heater fabric more flexible. Other types of fabric softeners could also be used to impart flexibility to the glass heater fabric.

EXAMPLE 6

A plant trial was run on two styles of glass fabric, 1562/38 and 7628/50. The test schedule was operated as follows:

YARDS 100 — 7628/50
50 — 1562/38

HEAT CLEANING: 50 yds. 7628/50 — I-537
(50 yds. 7628/50 — keep in greige)
50 yds. 1562/38 — batch oven

FINISHING:

COATING FORMULA:

| | | |
|---|---|---|
| 50 | gals. | Water |
| 21 | lbs. | Tamol SN |
| 7 | lbs. | TSPP |
| 83.4 | lbs. | Vulcan XC-72 |
| 126.8 | lbs. | Polidene M-3-120 |

MIXING PROCEDURE:

Using a Eppenback mixer, water, Tamol SN, and TSPP were mixed until the Tamol and TSPP dissolved.
Vulcan XC-72 was added and mixed until dispersed.
Then Polidene M-3-120 was added and mixed until a uniform mixture was obtained.

RUNNING CONDITIONS

Run A: Coronize 50 yards of 7628/50 greige at 1250°F and 20 yards per minute. Apply above formula in three dips, using submerged rolls, at 10 lbs. pad pressure, and dry between each dip at 300°F.

Run B: Take 50 yards 7628/50 I-537 and 50 yards 1562/38 batch oven and apply above formula in three dips, using submerged rolls, at 10 lbs. pad pressure, and dry between each dip at 300°F. Speed 20 yards per minute.

After processing the glass style 1562/38 as outlined in Runs A & B, copper electrodes were attached and the sample was coated with the polyvinylidene chloride vapor barrier coating. The resistance of this sample was 700 ohms per square foot. When 110 volts A.C. were connected to the electrodes, the sample produced 17.3 watts per square foot. The sample was then connected to 220 volts A.C. and the wattage output of the sample was 69.0 watts per square foot.

EXAMPLE 7

A representative sample of Run B from Example 6 was made with glass fabric style 1562. The resulting resistance of the fabric with electrodes spaced 12 inches apart was 700 ohms per square foot.

To test the effectiveness of the vapor barrier, the center of the fabric (equal distance between the electrodes) was immersed in salt water and the resistance measured between the salt water and the electrodes. The resistance was found to be in excess of 5 million ohms (5 megohms). The same sample prior to application of the vapor barrier coating had a resistance of 200 ohms.

This shows that the vapor barrier coating is protecting the conducting coating from moisture and from accidental contact with the "live" circuit.

To show the unexpected result of the vapor barrier coating on the uniformity of resistance and flex properties, a 1 inch wide sample of heater fabric 12 inches long was flexed over a ¼ inch diameter rod with the following results:

Resistance of a 1"×12" Strip ohms/square foot

| | Sample without Vapor Barrier | Sample with Vapor Barrier |
|---|---|---|
| Original | 666 | 1165 |
| Flexed 25 times | 1164 | 1335 |
| Flexed 50 times | 2164 | 1584 |
| Flexed 75 times | 4000 | 1665 |
| Flexed 100 times | 8333 | 1665 |
| % Change in Resistance | 1090.0 | 42.9 |

The sample without the vapor barrier showed a much larger change in resistance upon flexing than the sample with the vapor barrier coating. It is also important to note that the sample with the vapor barrier coating showed no further change in resistance after 75 flexes.

EXAMPLE 8

The glass heater fabric described in this invention can be used to make a heated ceiling tile in a relatively simple manner as described in this example.

Figure 3:
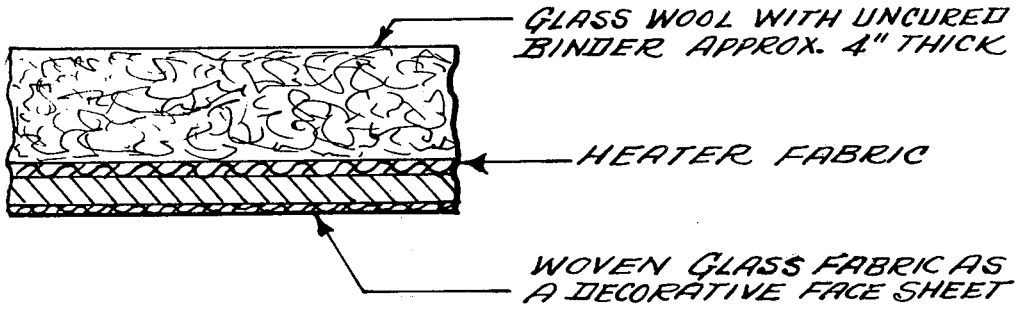
FIG. 3 is a cross section of a ceiling tile incorporating a heater fabric of the present invention.

A sample of style 1562 open weave glass fabric was made according to the process of Example 6 and electrodes attached 12 inches apart. The resistance of this sample was 605 ohms/square foot. When 110 volts A.C. were connected to the electrodes, the sample produced 20 watts per square foot of heat. This sample was incorporated into a ceiling time in the manner shown in FIG. 3.

This entire assembly was placed in a press and molded under pressure of 25 lbs. per square inch and a temperature of 450°F for 1 minute. The resultant product was a rigid structure intimately bonded together with a thickness of approximately ¼ inch, having excellent acoustical properties and appearances. When 110 volts A.C. were connected to the electrodes, the surface of the facing fabric was warm to the touch, and after a short period of time reached a temperature of 135°F.

To test the effectiveness of the vapor barrier coating, an area of 4 square inches in the center of the panel was saturated with salt water and the resistance measured to the electrodes. The resistance was found to be 5 megohms, indicating that the vapor barrier coating was acting both as a protection aganinst moisture and insulating the electric circuit.

EXAMPLE 9

A heater fabric sample of glass fabric style 1562 made, according to the process of Example 6, with electrodes spaced 12 inches apart demonstrates that cutouts or removed portions do not affect the heater fabric's ability to operate as a heat source.

Figure 4:
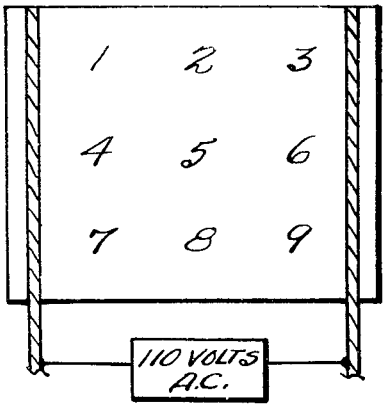
FIGS. 4 and 5 are plan views of a heater fabric showing the indicated temperature testing positions and removed portions.

With 110 volts A.C. connected to this sample, the surface temperature was measured with a surface pyrometer at the positions shown in FIG. 4 according to the following table. The resistance of the fabric was 230 ohms per square foot which gave a watt density of 55 watts per square foot.

TABLE II

| Location | Temperature — °F |
|---|---|
| 1 | 162 |
| 2 | 162 |
| 3 | 152 |
| 4 | 170 |
| 5 | 160 |
| 6 | 162 |
| 7 | 170 |

TABLE II-continued

| Location | Temperature — °F |
|---|---|
| 8 | 158 |
| 9 | 168 |

Figure 5:
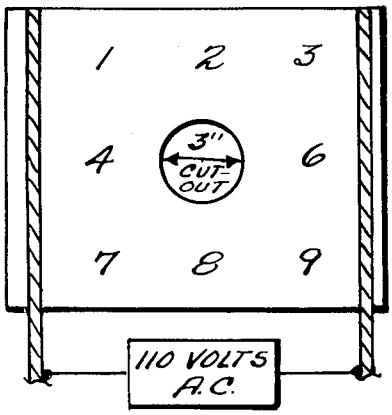

Next the same sample, as shown in FIG. 4, was cut to remove a 3 inch diameter hole in the center to produce the sample shown in FIG. 5. A voltage of 110 volts A.C. was again connected to the sample and the surface temperature measured, as shown in FIG. 5 according to the following table. The resistance of the sample with the cutout was 260 ohms per square foot which gave a watt density of 50.8 watts per square foot.

TABLE III

| Location | Temperature — °F |
|---|---|
| 1 | 138 |
| 2 | 150 |
| 3 | 148 |
| 4 | 130 |
| 5 | XXX |
| 6 | 130 |
| 7 | 150 |
| 8 | 152 |
| 9 | 150 |

EXAMPLE 10

Figure 6:
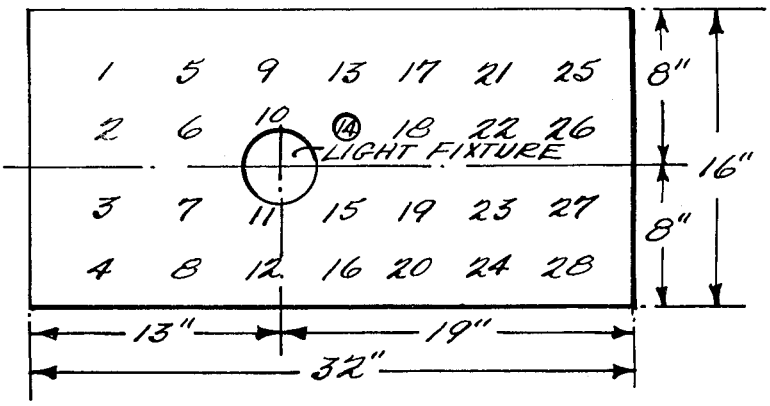
FIG. 6 is a plan view of a plaster board incorporating a heater fabric and a light fixture with the indicated temperature testing positions.
Figure 7:
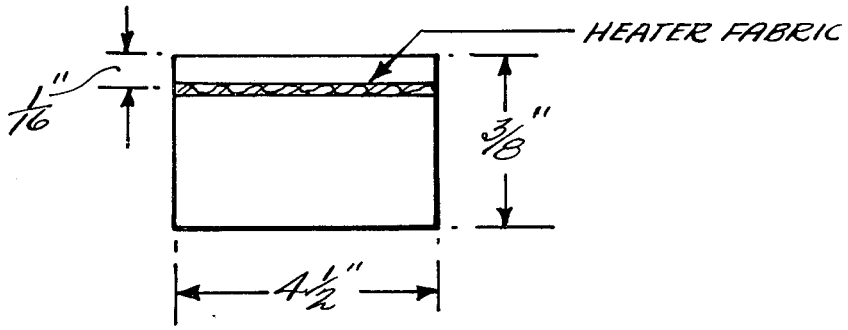
FIG. 7 is a cross section of the removed portion for the light fixture in FIG. 6.

Again using heater fabric made according to the process of Example 6, a plaster board was constructed with the heater fabric being incorporated into the wet plaster slurry. After drying, a cutout was made and a lamp fixture mounted on the board. The following table gives the temperature profile of the plaster board according to the plaster board of FIGS. 6 and 7.

TABLE IV

TEMPERATURE PROFILE STUDY
PLASTER BOARD WITH HEATER FABRIC AND NO INSULATION
Board Size - 16" × 32" × ⅜"

| | | | | |
|---|---|---|---|---|
| 1 | 128°F | 16 | 128°F | |
| 2 | 128°F | 17 | 128°F | HEATER FABRIC |
| 3 | 128°F | 18 | 128°F | SIZE - 14" × 31" |
| 4 | 128°F | 19 | 128°F | |
| 5 | 130°F | 20 | 128°F | R=330 OHMS |
| 6 | 131°F | 21 | 128°F | |
| 7 | 130°F | 22 | 131°F | E=240 VOLTS |
| 8 | 131°F | 23 | 135°F | |
| 9 | 115°F | 24 | 138°F | I=0.727 AMPS |
| 10 | 115°F | 25 | 128°F | |
| 11 | 117°F | 26 | 128°F | WATTS=174.5 |
| 12 | 119°F | 27 | 130°F | |
| 13 | 120°F | 28 | 135°F | WATTS/SQ.FT = 57.7 |
| 14 | 150°F | | | |
| 15 | 131°F | | | |

The heater fabric continued to operate on a satisfactory basis.

EXAMPLE 11

Figure 8:
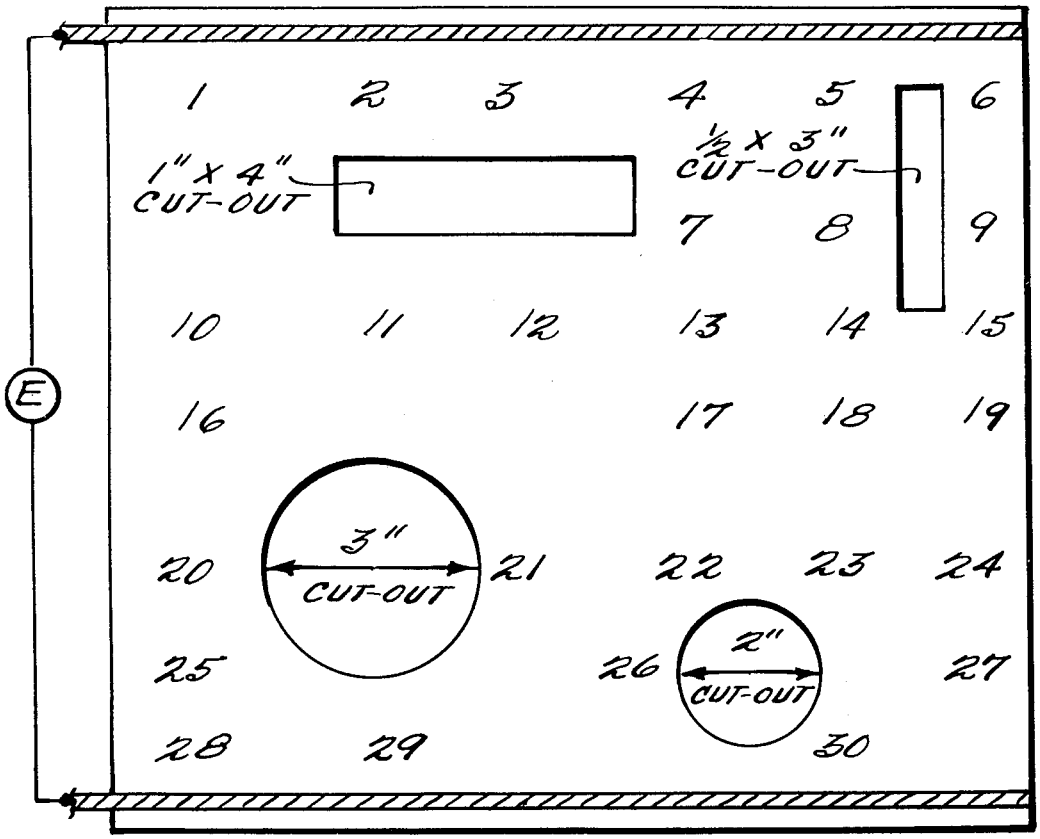
FIG. 8 is a plan view similar to FIG. 5 for a laminate with a heater fabric.

Another temperature profile study was conducted on a polyester-glass laminate with the heater fabric made according to the process of Example 6 as part of the structure. The effects of cutouts on the surface temperature were measured with the results as follows. The laminate which is shown in FIG. 8 is a 12 × 11 inches polyester glass laminate with glass heater fabric having 12 plies polyester and 1 ply heater fabric under the following conditions:

R=700 OHMS
E=115 VOLTS

I=0.149
WATTS=17.13

TABLE V

| Position | Temperature |
|---|---|
| 1 | 110 |
| 2 | 110 |
| 3 | 95 |
| 4 | 110 |
| 5 | 115 |
| 6 | 110 |
| 7 | 120 |
| 8 | 115 |
| 9 | 110 |
| 10 | 110 |
| 11 | 108 |
| 12 | 100 |
| 13 | 109 |
| 14 | 108 |
| 15 | 108 |
| 16 | 110 |
| 17 | 110 |
| 18 | 110 |
| 19 | 105 |
| 20 | 110 |
| 21 | 120 |
| 22 | 115 |
| 23 | 120 |
| 24 | 110 |
| 25 | 110 |
| 26 | 115 |
| 27 | 110 |
| 28 | 105 |
| 29 | 100 |
| 30 | 100 |

The heater fabric continued to operate on a satisfactory basis.

What is claimed is:

1. An electrically heated ceiling tile comprising in a layer sequence a glass wool backing, a flexible heater fabric and a woven glass fabric as an electrically decorative face sheet, said flexible heater fabric comprising a woven glass cloth having a layer of a conductive mixture to provide a desired watt density comprising carbon and a vinylidene chloride polymer, electrical means in contact with the conductive mixture for applying an electrical potential and a vapor barrier of a vinylidene chloride polymer to protect the conductive mixture from moisture and accidental electrical contact.

2. A plaster board comprising a flexible heater fabric incorporated into a plaster binder, said heater fabric comprising a woven glass cloth having a layer of an electrically conductive mixture to provide a desired watt density comprising carbon and a vinylidene chloride polymer, electrical means in contact with the conductive mixture for applying an electrical potential and a vapor barrier of a vinylidene chloride polymer to protect the conductive mixture from moisture and accidental electrical contact.

3. An electrically laminate comprising at least one layer of a polyester material and a flexible heater fabric comprising a woven glass cloth having a layer of an electrically conductive mixture to provide a desired watt density comprising carbon and a vinylidene chloride polymer, means in contact with the conductive mixture for applying an electrical potential and a vapor barrier of a vinylidene chloride polymer to protect the conductive mixture from moisture and accidental electrical contact.

* * * * *